US009649848B1

(12) United States Patent
Begeal et al.

(10) Patent No.: US 9,649,848 B1
(45) Date of Patent: May 16, 2017

(54) INK RECIRCULATION FOR DROP-ON-DEMAND INK JET SYSTEMS

(71) Applicants: Carlton E. Begeal, Golden, CO (US); Carl R. Bildstein, Lafayette, CO (US); Timothy Graham Bradley, Longmont, CO (US); Dilan Nirushan Fernando, Thornton, CO (US); Ronald Frederick Korsch, Longmont, CO (US); Casey E. Walker, Boulder, CO (US)

(72) Inventors: Carlton E. Begeal, Golden, CO (US); Carl R. Bildstein, Lafayette, CO (US); Timothy Graham Bradley, Longmont, CO (US); Dilan Nirushan Fernando, Thornton, CO (US); Ronald Frederick Korsch, Longmont, CO (US); Casey E. Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/052,249

(22) Filed: Feb. 24, 2016

(51) Int. Cl.
*B41J 2/18* (2006.01)
*B41J 2/175* (2006.01)
*B41J 2/185* (2006.01)

(52) U.S. Cl.
CPC ..... *B41J 2/18* (2013.01); *B41J 2/17596* (2013.01); *B41J 2002/1856* (2013.01)

(58) Field of Classification Search
CPC . B41J 2/175; B41J 2/18; B41J 2/17596; B41J 2/19; B41J 2/185; B41J 2/17566; B41J 2/165; B41J 2/1707; B41J 2/1721; B41J 2/17523; B41J 2202/12; B41J 2002/1856
USPC ..... 347/6, 7, 9, 22, 29, 30, 34, 84, 85, 89, 347/90, 92
See application file for complete search history.

(56) References Cited

U.S. PATENT DOCUMENTS

| | | | |
|---|---|---|---|
| 4,403,227 | A | 9/1983 | Bertschy et al. |
| 6,431,694 | B1 | 8/2002 | Ross |
| 6,817,705 | B1 | 11/2004 | Crockett et al. |
| 7,594,717 | B2 | 9/2009 | Sheinman |
| 7,628,475 | B2 | 12/2009 | Langford et al. |
| 7,901,063 | B2 | 3/2011 | Wouters et al. |
| 8,220,896 | B2 | 7/2012 | Nystrom et al. |
| 8,403,457 | B2 | 3/2013 | Frazier et al. |
| 8,444,259 | B2 | 5/2013 | Bennett |
| 8,591,000 | B1 | 11/2013 | Snyder |

(Continued)

*Primary Examiner* — Jannelle M Lebron
(74) *Attorney, Agent, or Firm* — Duft Bornsen & Fettig, LLP

(57) ABSTRACT

Embodiments described herein provide ink recirculation capabilities for Drop-On-Demand (DOD) printing systems. One embodiment comprises a system that includes a controller, a DOD print head, an ink tank, an ink pump, and a recirculation cap. The ink pump transports ink from the ink tank to the DOD print head, and the recirculation cap captures ink ejected by the DOD print head. The recirculation cap also transports the capture ink to the ink tank. In response to detecting a start of an ink recirculation cycle, the controller collocates the recirculation cap proximate to nozzles of the DOD print head, and directs the DOD print head to begin ejecting ink through the nozzles into the recirculation cap for transport of the captured ink to the ink tank. The controller detects an end to the ink recirculation cycle, and directs the DOD print head to stop ejecting ink into the recirculation cap.

15 Claims, 5 Drawing Sheets

(56) References Cited

U.S. PATENT DOCUMENTS

| | | | | |
|---|---|---|---|---|
| 9,085,163 | B2 | 7/2015 | Sunouchi et al. | |
| 2006/0244799 | A1 * | 11/2006 | Sasa | B41J 2/16523 347/89 |
| 2010/0026739 | A1 * | 2/2010 | Hirashima | B41J 2/16523 347/6 |

* cited by examiner

INK RECIRCULATION FOR DROP-ON-DEMAND INK JET SYSTEMS

FIELD

This disclosure relates to the field of printing systems, and in particular, to printing systems that utilize ink jet ejection systems and liquid inks.

BACKGROUND

Ink jet printing systems mark a printable medium by propelling droplets of ink onto the medium. Although a number of variations exist in the types of ink jet printing systems that are in use, the two main types of ink jet printing systems are Drop-On-Demand (DOD) printing systems and continuous ejection printing systems. DOD printing systems utilize heating elements or piezoelectric elements within ink ejection nozzles to propel ink on demand onto the medium. Continuous ejection printing systems utilize a continuous stream of ink and electrostatic fields to control the placement of the ink onto the medium.

One potential problem associated with DOD printing systems is that there are periods of time when the ink is not being ejected from the nozzles. When ink is not being ejected, there is little to no flow of ink through the printing system. In this case, ink that is held in various locations within the printing system (e.g., ink in the feed lines and/or reservoirs, and/or print nozzles) can undergo changes in the characteristics of the ink. For example, if the ink is used for Magnetic Ink Character Recognition (MICR) printing, then metal particles used in such inks can settle or stratify within the printing system, which is undesirable. Such settling or stratification can change the ratio of metal particles to liquid in the ink, which can cause printing problems or print quality problems. Further, ink that is held in the nozzles during periods of print inactivity can change viscosity or harden, both of which can clog nozzles or reduce the quality of the printed output of the printing system.

DOD printing systems often attempt to mitigate these issues by ejecting and discarding ink during periods of print inactivity. However, this type of process wastes ink and can increase the operating costs of the printing system.

SUMMARY

Embodiments described herein provide ink recirculation capabilities for DOD printing systems. Using recirculation, ink in a printing system can flow through the various ink supply systems, such as supply lines, air trap tanks, print heads, etc., during periods of print inactivity. The use of recirculation reduces the need for ejecting and discarding ink.

One embodiment comprises a system that includes a controller, a DOD print head, an ink tank, an ink pump, and a recirculation cap. The ink pump transports ink from the ink tank to the DOD print head, and the recirculation cap captures ink ejected by the DOD print head. The recirculation cap also transports the captured ink to the ink tank. In response to detecting a start of an ink recirculation cycle, the controller collocates the recirculation cap proximate to nozzles of the DOD print head, and directs the DOD print head to begin ejecting ink through the nozzles into the recirculation cap for transport of the captured ink to the ink tank. The controller detects an end to the ink recirculation cycle, and directs the DOD print head to stop ejecting ink into the recirculation cap.

Another embodiment comprises a method operable by a DOD printing system for recirculating ink. The method comprises detecting a start of an ink recirculation cycle, and collocating a recirculation cap proximate to nozzles of a DOD print head. The method further comprises transporting ink from an ink tank to the DOD print head. The method further comprises directing the DOD print head to begin ejecting ink through the nozzles into the recirculation cap to recirculate the captured ink back to the ink tank. The method further comprises directing the DOD print head to stop ejecting the ink into the recirculation cap responsive to detecting an end of the recirculation cycle.

Another embodiment comprises a non-transitory computer readable medium embodying programmed instructions which, when executed by a processor of a DOD printing system, direct the processor to detect a start of an ink recirculation cycle, and to collocate a recirculation cap proximate to nozzles of a DOD print head. The instructions further direct the processor to transport ink from an ink tank to the DOD print head, and to direct the DOD print head to begin ejecting ink through the nozzles into the recirculation cap to recirculate the captured ink back to the ink tank. The instructions further direct the processor to direct the DOD print head to stop ejecting the ink into the recirculation cap responsive to detecting an end of the ink recirculation cycle.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments are now described, by way of example only, and with reference to the accompanying drawings. The same reference number represents the same element or the same type of element on all drawings.

DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
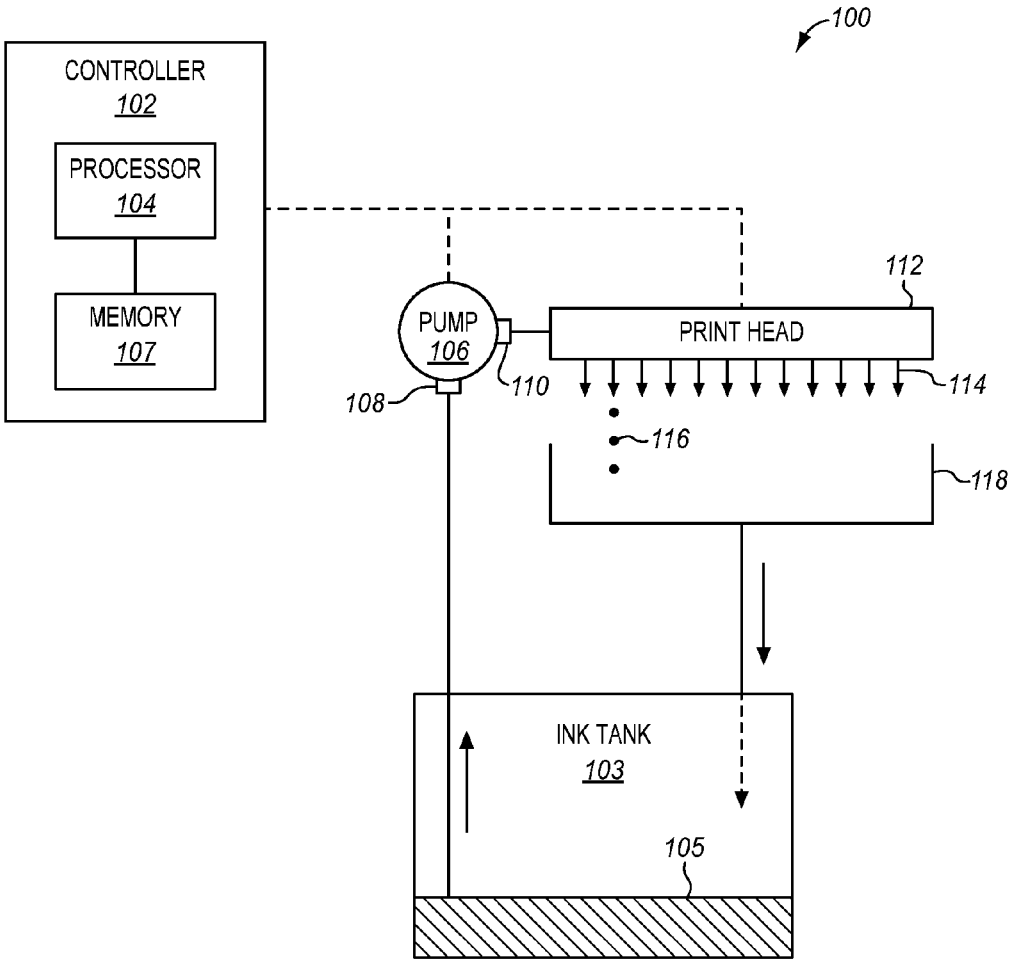
FIG. 1 is block diagram of a DOD printing system in an exemplary embodiment.

FIG. 1 is block diagram of a DOD printing system 100 in an exemplary embodiment. In this embodiment, printing system 100 includes a controller 102. Controller 102 includes any component, system, or device that is able to control and coordinate the recirculation of ink within printing system 100. In this embodiment, printing system 100 includes an ink tank 103 that stores ink 105. Ink tank 103 supplies ink 105 to an inlet 108 of a pump 106, which delivers ink 105 to a DOD print head 112 via an outlet 110 of pump 106.

Print head 112 includes a plurality of nozzles 114, which discharge drops 116 of ink 105 on demand. Print head 112 may utilize heating elements or piezoelectric elements that are in fluid communication with nozzles 114. Nozzles 114 eject drops 116 of ink 105. During a printing process, image data defines which of nozzles 114 eject ink, thereby converting the image data into print images onto a medium.

During periods of inactivity of the printing process, it may be desirable to recirculate ink 105 within printing system 100. Recirculating ink 105 may provide printing system 100 with a number of benefits, such as preventing viscosity changes in ink 105, which may occur as ink 105 dries in nozzles 114. Recirculating ink 105 may also prevent the settling or stratification of ink 105 when printing system 100 uses magnetic inks. Magnetic inks, or MICR inks, utilize metal particles to allow printed documents to be read by a MICR reader. One example of MICR printing includes check printing. In other embodiments, ink 105 may comprise a protector coat, under coat, or any other type of fluid that may be jetted from print head 112.

In this embodiment, printing system 100 includes a recirculation cap 118, which is used to facilitate the recirculation of ink 105 within printing system 100. Cap 118 may have a shape, size, and construction that allows cap 118 to fit over and/or proximate to nozzles 114 of print head 112. For instance, cap 118 may include a seal or other feature that allows cap 118 to make an air-tight seal against print head 112 proximate to nozzles 114, which further reduces the contact of air with ink 105 during an ink recirculation cycle. During a recirculation cycle, cap 118 captures drops 116 of ink 105 ejected by nozzles 114 and direct or transports ink 105 back to ink tank 103. Recirculation of ink 105 within printing system 100 can mitigate the problems that may arise when printing system 100 is not printing to a medium, such as viscosity changes in inks and/or settling of materials (e.g., metal particles) mixed with the inks.

While the specific hardware implementation of controller 102 is subject to design choices, one particular embodiment may include one or more processors 104 coupled with memory 107. Processor 104 includes any electronic circuits and/or optical circuits that are able to perform functions. For example, processor 104 may perform any functionality described herein for controller 102. Processor 104 may include one or more Central Processing Units (CPU), microprocessors, Digital Signal Processors (DSPs), Application-specific Integrated Circuits (ASICs), Programmable Logic Devices (PLD), control circuitry, etc. Some examples of processors include INTEL® CORE™ processors, Advanced Reduced Instruction Set Computing (RISC) Machines (ARM®) processors, etc.

Memory 107 includes any electronic circuits, and/or optical circuits, and/or magnetic circuits that are able to store data. For instance, memory 107 may be used to store parameter information regarding the implementation of ink recirculation cycles performed by printing system 100. Such parameter information may include rules, conditions, etc., for when, and/or how long to perform a recirculation cycle. Determining when and/or how long to perform a recirculation cycle may depend upon the types of ink 105, the idle time of printing system 100 between printing jobs, humidity at the location of printing system 100, the temperature of the location of printing system 100, the temperature of ink 105, etc. Memory 107 may include one or more volatile or non-volatile Dynamic Random Access Memory (DRAM) devices, FLASH devices, volatile or non-volatile Static RAM devices, magnetic disk drives, Solid State Disks (SSDs), etc. Some examples of non-volatile DRAM and SRAM include battery-backed DRAM and battery-backed SRAM.

Figure 2:
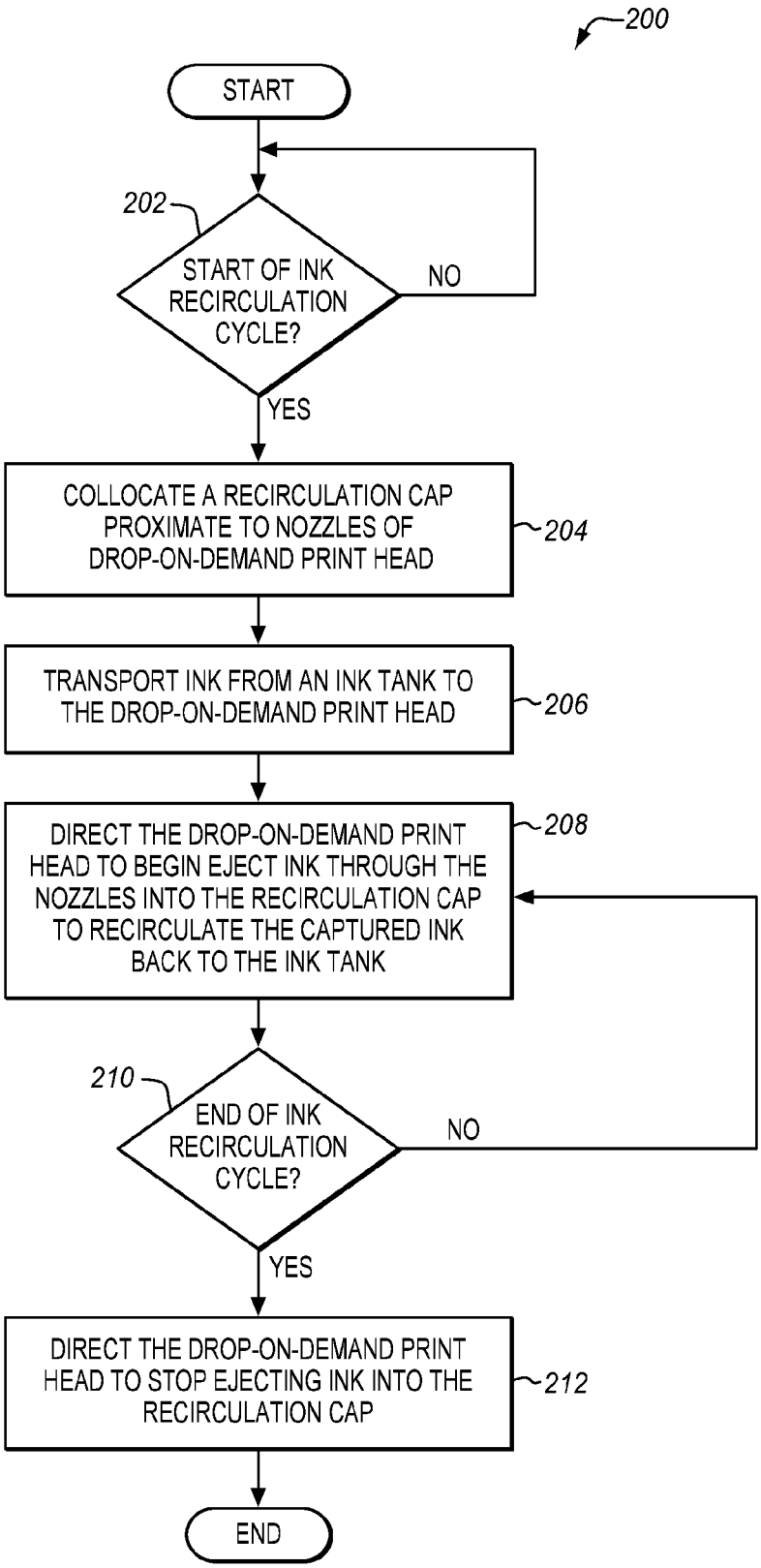
FIG. 2 is a flow chart of a method for recirculating ink in a DOD printing system in an exemplary embodiment.

When printing system 100 is operational and is not currently printing jobs to a printable medium, an ink recirculation cycle may be performed. FIG. 2 is a flow chart of a method 200 for recirculating ink in a DOD printing system in an exemplary embodiment. Method 200 will be discussed with respect to printing system 100 of FIG. 1, although method 200 may be performed by other systems, not shown. The steps of the flow charts described herein may include other steps that are not shown. Also, the steps of the flow charts described herein may be performed in an alternate order.

Processor 104 determines whether a start of an ink recirculation cycle has been initiated (see step 202). To do so, processor 104 may determine whether a trigger or other event has occurred. For instance, processor 104 may determine that a time limit after printing has expired, that printing system 100 has been idle for longer than a threshold time, etc.

Upon start of an ink recirculation cycle, processor 104 will collocate cap 118 proximate to nozzles 114 of print head 112 (see step 204). To collocate cap 118 and print head 112, processor 104 may direct an actuator or other mechanical system to move an opening of cap 118 into position proximate to nozzles 114. For instance, cap 118 may be retained out of a printing position during a printing process, and moved into position proximate to print head 114 when printing system 100 is not actively printing to a medium.

In addition or instead of, processor 104 may direct an actuator or other mechanical system to move print head 112 into position proximate to cap 118 by placing nozzles 114 of print head 112 over an opening of cap 118. For instance, cap 118 may be mounted out of a printing position for print head 112, with print head 112 moved proximate to an opening of cap 118 when printing system 100 is not actively printing to a medium.

When cap 118 is in position, processor 104 directs the transport of ink 105 from ink tank 103 to print head 112 (see step 206). For instance, processor 104 may actuate pump 106, which draws ink 105 from ink tank 103, and feeds ink 105 to print head 112.

Processor 104 directs print head 112 to begin ejecting ink 105 into cap 118 via nozzles 114 (see step 208). Drops 116 of ink 105 are captured by cap 118, which directs ink 105 back to ink tank 103. In this process, ink 105 is drawn from ink tank 103, fed to print head 112, captured by cap 118, and transported back to ink tank 103.

Recirculating ink 105 in this manner can mitigate the problems that may arise when printing system 100 is not printing, such as settling and/or stratification of ink 105, viscosity changes of ink 105, etc. Processor 104 determines whether an end to the ink recirculation cycle has occurred (see step 210). Ink recirculation may be terminated for a number of reasons, including a length of time that ink recirculation has been performed, the start of a new print job, etc.

In response to the end of the ink recirculation cycle, processor 104 directs print head 112 to stop ejecting ink 105 into cap 118 (see step 212). For instance, processor 104 may turn off pump 106, may provide instructions to print head 112 to discontinue the ejection of ink 105 through nozzles 114, etc. In response to the end of the ink recirculation cycle, printing system 100 is now available to resume normal printing operations.

Figure 3:
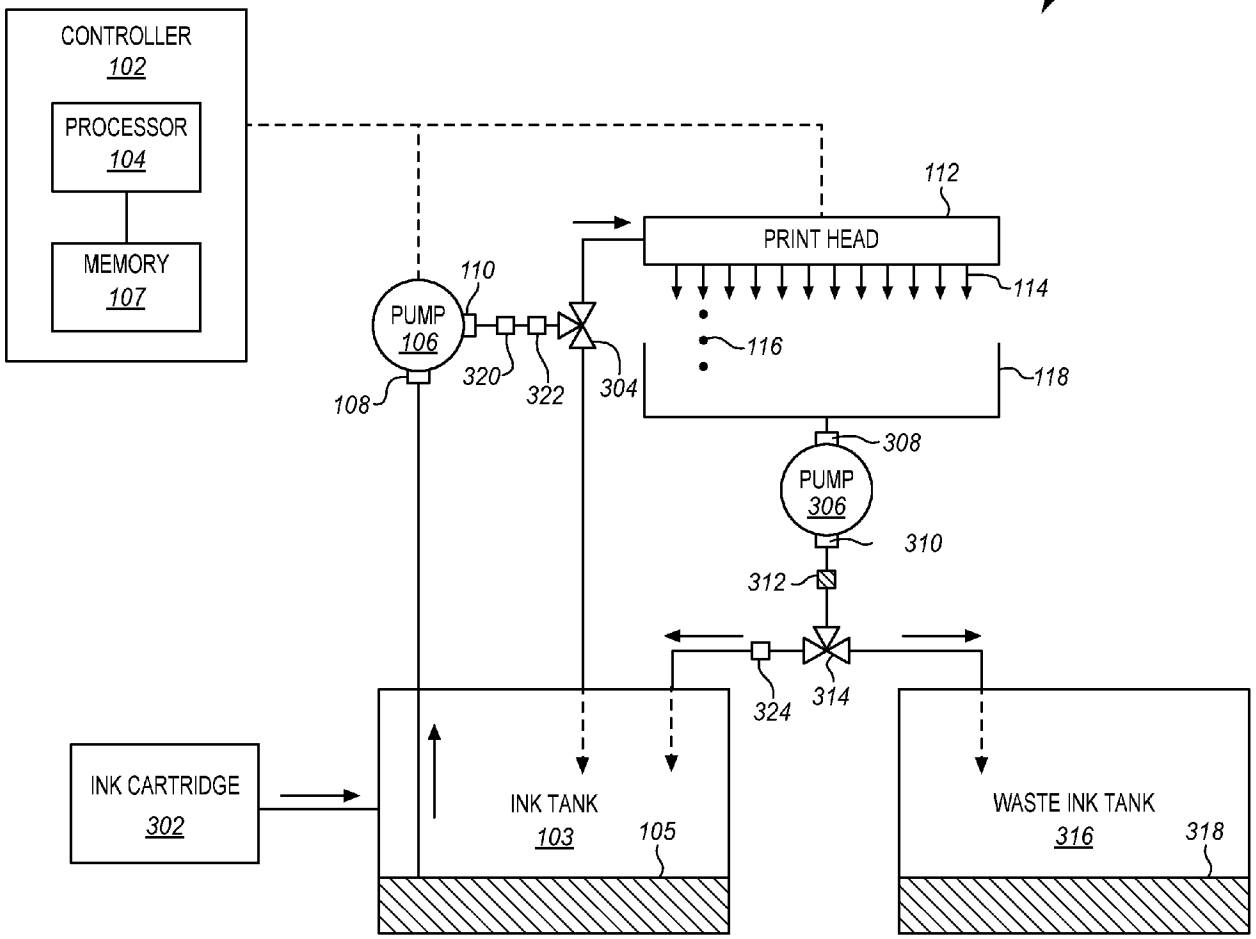
FIG. 3 is a block diagram of another DOD printing system in an exemplary embodiment.

FIG. 3 is a block diagram of another DOD printing system 300 in an exemplary embodiment. In this embodiment, printing system 300 includes an ink cartridge 302, which is in fluid communication with ink tank 103. Ink cartridge 302 stores ink 105, and supplies ink 105 to ink tank 103. In some embodiments, ink tank 103 may comprise an air trap tank, which is used in printing systems to trap air in ink 105.

Printing system 300 in this embodiment further includes a waste ink tank 316 that stores discarded ink 318. Ink 105 may be discarded by printing system 300 in certain cases, such as when the viscosity of ink 105 is greater than a threshold. The viscosity of ink 105 may change as ink 105 dries, due to contact with air.

Printing system 300 further includes a 3-way valve 304, which couples output 110 of pump 106 to either print head 112 or ink tank 103. Processor 104 directs valve 304 to recirculate ink 105 either back to ink tank 103 via outlet 110 of pump 106, or back to ink tank 103 via print head 112 and cap 118. In some embodiments, an ink filter 320 and/or a degas module 322 may be in line between outlet 110 of pump 106, and 3-way valve 304. Ink filter 320 is used to filter ink 105. Degas module 322 is used to degas ink 105.

An ink ejection pump 306 is located in an ink return line from cap 118, and is used to draw ink out of cap 118 and transport the ink back to either ink tank 103 or waste ink tank 316. Pump 306 includes an inlet 308 proximate to an ink return line from cap 118, and an outlet 310. A viscosity sensor 312 is in line with the outlet 310 of pump 306, although viscosity sensor 312 may be in line with the inlet 308 in some embodiments. Viscosity sensor 312 is able to measure a viscosity of ink 105, and provide the measurements to controller 102. Pump 306 may also be able to draw a vacuum at recirculation cap 118, when recirculation cap 118 is in contact with print head 112. Drawing a vacuum at recirculation cap 118 could be used to draw ink 105 from print head 112.

Another 3-way valve 314 is located downstream of pump 306, and is used by controller 102 to send ink captured by cap 118 either to ink tank 103, or to waste ink tank 316. In some embodiments, an ink filter 324 is located in line between 3-way valve 314 and ink tank 103. Controller 102 may send ink captured by cap 118 to waste ink tank 316 depending on the quality of ink 105, in cases where printing system 100 is being serviced, in cases where the quality of ink 105 is unknown, etc. Or, for example, controller 102 may recirculate ink 105 through print heads 112 to warm up ink 105 and/or to warm up print head 112 prior to printing. It may be desirable to send ink 105 after this process to either ink tank 103 or waste ink tank 316.

Figure 4:
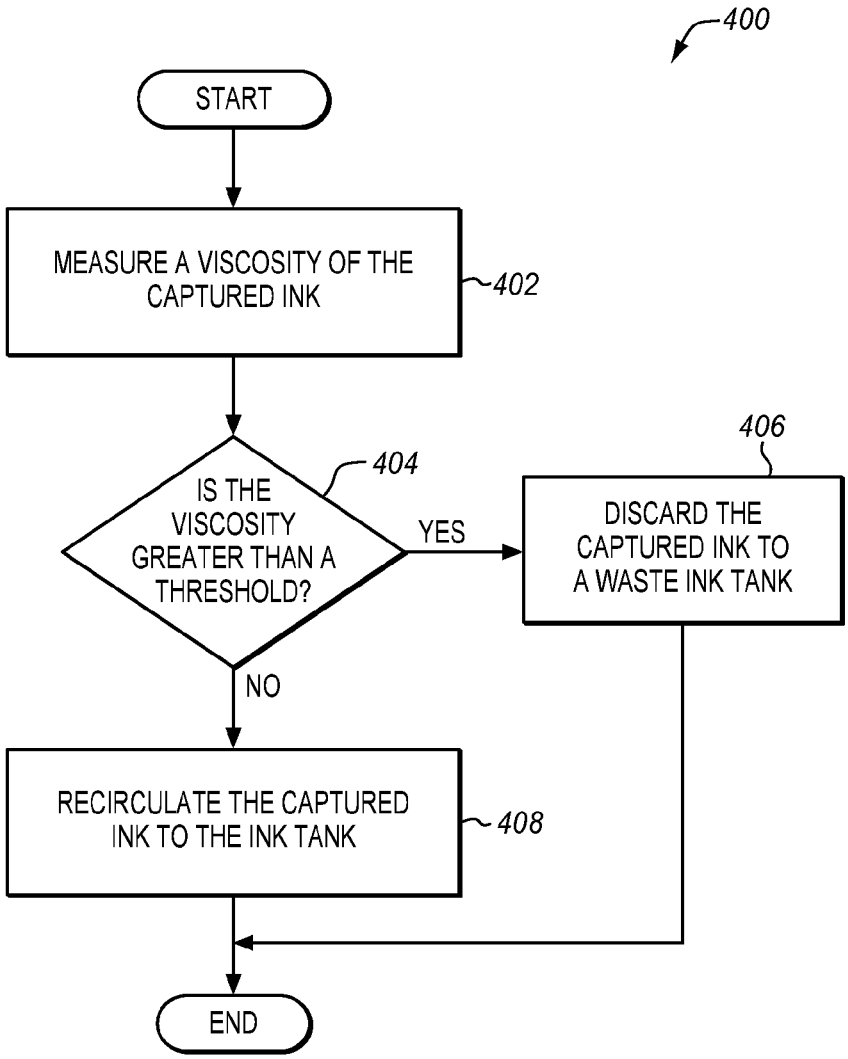
FIG. 4 is a flow chart illustrating additional steps of the method of FIG. 2 in an exemplary embodiment.

FIG. 4 is a flow chart illustrating additional steps of the method of FIG. 2 in an exemplary embodiment. The steps illustrated in FIG. 4 will be discussed with respect to printing system 300, although the steps may be performed by other systems, not shown.

During a recirculation cycle, two possible ink flow paths are present in printing system 300. One flow path occurs from ink tank 103, through pump 106, and back to ink tank 103 through valve 304. This flow path may be used in cases where it may not be necessary to utilize print head 112 in the flow path. For instance, if ink 105 is a MICR ink, then settling or stratification within ink tank 103 may be prevented using this type of flow path, since the movement alone of ink 105 would be sufficient to achieve this result. Another possibility is that it is desired to degas ink 105. When degas module 322 is present, this flow path may be used to degas ink 105 while bypassing print head 112.

Another flow path was previously described with respect to FIG. 2, which is from ink tank 103, through pump 106, through print head 112, and into cap 118. This flow path may be used in cases where preventing clogging or drying of ink within nozzles 114 is a concern. In some embodiments, it may be desirable to monitor the quality of ink 105 during the recirculation cycle, since changes in viscosity of ink 105 may warrant either discarding ink 105 to waste ink tank 316, or mixing fresh ink from cartridge 302 to decrease the viscosity of ink 105. These two embodiments will be discussed next.

During a recirculation cycle, processor 104 utilizes viscosity sensor 312 to measure a viscosity of ink 105 (see step 402 of FIG. 4). Generally, viscosity of ink 105 may change when exposed to air, with ink 105 increasing in viscosity. Processor 104 determines whether the viscosity of ink 105 is greater than a threshold (see step 404). If the viscosity is greater than the threshold, then processor 104 discards ink 105 into waste ink tank 316 (see step 406). To discard ink 105, processor 104 may actuate valve 314 to direct ink 105 captured from cap 118 toward waste ink tank 316. If the viscosity is less than the threshold, then processor 104 recirculates ink 105 captured from cap 118 to ink tank 103. To recirculate ink 105, processor 104 may actuate valve 314 to direct ink 105 captured from cap 118 towards ink tank 103. Discarding ink 105 due to viscosity changes may be desirable when the use of ink 105 in this degraded state would impact the reliability and/or print quality of printing system 300.

In some embodiments, it may be desirable to discard ink 105 when the viscosity of ink 105 is outside of a range of viscosities. For instance, the addition of cleaning fluid to print head 112 and/or cap 118 may reduce the viscosity of ink 105 captured by cap 118 below a desired viscosity, while drying of ink 105 may increase the viscosity of ink 105 captured by cap 118 above a desired viscosity. In these embodiments, processor 104 may determine whether the viscosity measured by viscosity sensor 312 is either too low or too high, which would be undesirable. When the viscosity is either too low or too high, processor 104 directs 3-way valve 314 to discard ink 105 and/or cleaning fluid to waste ink tank 316. If the viscosity is within the range, then processor 104 directs 3-way valve 314 to return ink 105 to ink tank 103.

In some embodiments, system 300 may be shipped with a non-ink fluid that replaces ink 105. Upon setup, ink tank 103 is filled with ink 105. Ink 105 is then pumped through system 300 to waste ink tank 316 to replace the transport fluid. In these embodiments, processor 104 may monitor a decreasing viscosity at viscosity sensor 312 as ink 105 replaces the transport fluid. When processor 104 determines that the viscosity decreases to within a desired range of viscosities, processor 104 may then direct 3-way valve 314 to stop directing ink 105 to waste ink tank 316 and instead, direct ink 105 to ink tank 103.

In some embodiments, it may be desirable to mix fresh ink from ink cartridge 302 with ink 105 stored in ink tank 103. For instance, if processor 104 determines that the viscosity of ink 105 is greater than a threshold, then reducing the viscosity of ink 105 may be possible if ink cartridge 302 mixes fresh ink with ink 105 in ink tank 103. Therefore, this activity is also possible if processor 104 determines that the quality of ink 105 is low based on the measurement of the viscosity of ink 105 during the recirculation cycle.

Ink recirculation provides a number of advantages to printing systems that utilize liquid inks. Some of those advantages include reducing the amount of ink that is discarded, reducing the stratification and/or settling of materials within the ink within different portions of the printing systems, etc.

Any of the various elements shown in the figures or described herein may be implemented as hardware, software, firmware, or some combination of these. For example, an element may be implemented as dedicated hardware. Dedicated hardware elements may be referred to as "processors", "controllers", or some similar terminology. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, a network processor, application specific integrated circuit (ASIC) or other circuitry, field programmable gate array (FPGA), read only memory (ROM) for storing software, random access memory (RAM), non-volatile storage, logic, or some other physical hardware component or module.

Also, an element may be implemented as instructions executable by a processor or a computer to perform the functions of the element. Some examples of instructions are software, program code, and firmware. The instructions are operational when executed by the processor to direct the processor to perform the functions of the element. The instructions may be stored on storage devices that are readable by the processor. Some examples of the storage devices are digital or solid-state memories, magnetic storage media such as a magnetic disks and magnetic tapes, hard drives, or optically readable digital data storage media.

Figure 5:
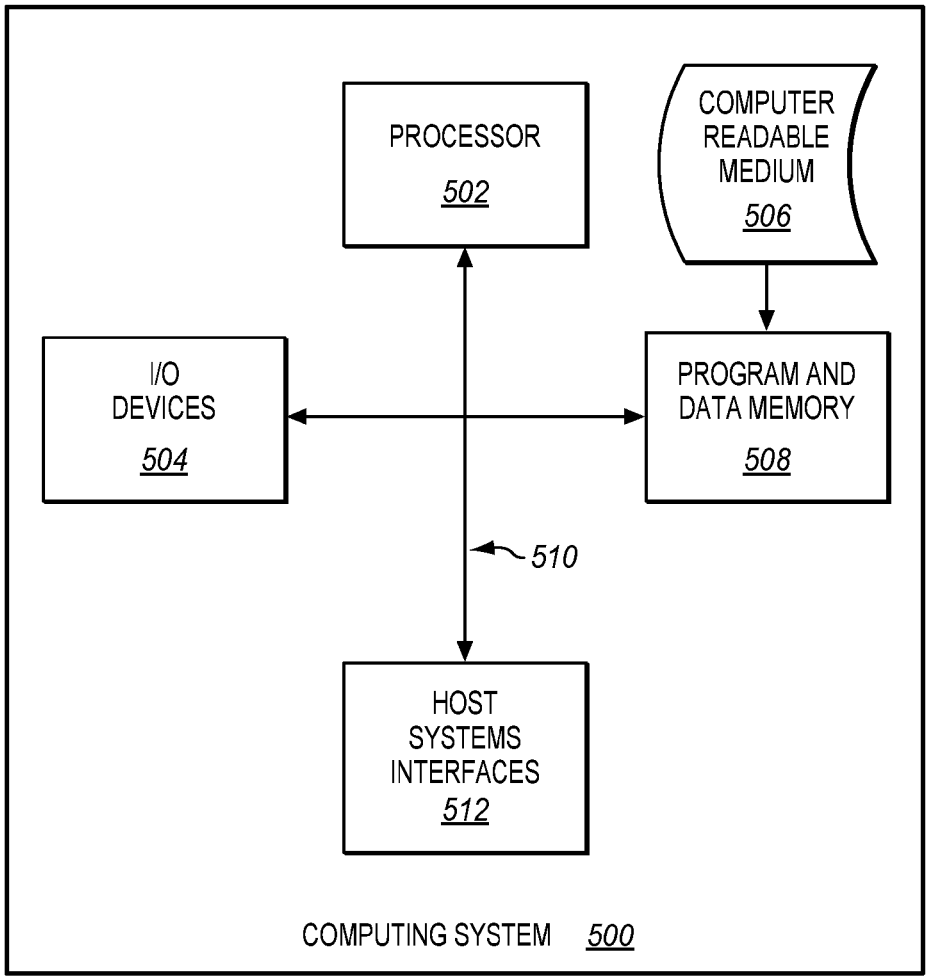
FIG. 5 illustrates a computing system in which a computer readable medium may provide instructions for performing any of the functionality disclosed herein for the embodiments described herein.

In one embodiment, the invention is implemented in software, which includes but is not limited to firmware, resident software, microcode, etc. FIG. 5 illustrates a computing system 500 in which a computer readable medium 506 may provide instructions for performing any of the functionality disclosed herein for controller 102.

Furthermore, the invention can take the form of a computer program product accessible from computer readable medium 506 that provides program code for use by or in connection with a processor or any instruction execution system. For the purposes of this description, computer readable medium 506 can be any apparatus that can tangibly store the program for use by or in connection with the instruction execution system, apparatus, or device, including computer system 500.

Computer readable medium 506 can be any tangible electronic, magnetic, optical, electromagnetic, infrared, or semiconductor system (or apparatus or device). Examples of computer readable medium 506 include a semiconductor or solid state memory, magnetic tape, a removable computer diskette, a random access memory (RAM), a read-only memory (ROM), a rigid magnetic disk and an optical disk. Some examples of optical disks include compact disk-read only memory (CD-ROM), compact disk-read/write (CD-R/W) and DVD.

Computing system 500, suitable for storing and/or executing program code, can include one or more processors 502 coupled directly or indirectly to memory 508 through a system bus 510. Memory 508 can include local memory employed during actual execution of the program code, bulk storage, and cache memories which provide temporary storage of at least some program code in order to reduce the number of times code is retrieved from bulk storage during execution. Input/output or I/O devices 504 (including but not limited to keyboards, displays, pointing devices, etc.) can be coupled to the system either directly or through intervening I/O controllers. Network adapters may also be coupled to the system to enable computing system 500 to become coupled to other data processing systems, such as through host systems interfaces 512, or remote printers or storage devices through intervening private or public networks. Modems, cable modem and Ethernet cards are just a few of the currently available types of network adapters.

Although specific embodiments were described herein, the scope is not limited to those specific embodiments. Rather, the scope is defined by the following claims and any equivalents thereof.

The invention claimed is:

1. A system, comprising:

a controller;

a Drop-On-Demand (DOD) print head;

an ink tank;

an ink pump configured to transport ink from the ink tank to the DOD print head;

a recirculation cap configured to capture the ink ejected by the DOD print head;

a waste ink tank; and a first 3-way valve in fluid communication with the recirculation cap, the ink tank, and the waste ink tank, wherein the controller, responsive to detecting a start of an ink recirculation cycle, is configured to collocate the recirculation cap proximate to nozzles of the DOD print head, to actuate the first 3-way valve to selectively direct the captured ink to one of the ink tank and the waste ink tank, and to direct the DOD print head to begin ejecting ink through the nozzles into the recirculation cap for transport of the captured ink to one of the ink tank and the waste ink tank based on the first 3-way valve, wherein the controller, responsive to detecting an end of the ink recirculation cycle, is configured to direct the DOD print head to stop ejecting the ink into the recirculation cap.

2. The system of claim 1 further comprising:

a second 3-way valve in fluid communication with an output of the ink pump, the ink tank, and the DOD print head, wherein the controller is configured to actuate the second 3-way valve to selectively direct the ink to one of the ink tank and the DOD print head during the ink recirculation cycle.

3. The system of claim 1 wherein:

the controller, responsive to the start of the ink recirculation cycle, is configured to perform one of the following:

move the DOD print head proximate to the recirculation cap; and move the recirculation cap proximate to the DOD print head.

4. The system of claim 1 further comprising:

an ink cartridge in fluid communication with the ink tank; and a viscosity sensor configured to measure a viscosity of the captured ink, wherein the controller is configured to determine that the viscosity of the captured ink is greater than a threshold, and to add ink to the ink tank utilizing the ink cartridge to decrease the viscosity of the captured ink in response to the determination.

5. The system of claim 1 further comprising:

a viscosity sensor configured to measure a viscosity of the captured ink;

wherein the controller is configured to determine whether the viscosity of the captured ink is greater than a threshold, and to:

direct the first 3-way valve to discard the captured ink to the waste ink tank in response to determining that the viscosity is greater than the threshold; and direct the first 3-way valve to recirculate the captured ink to the ink tank in response to determining that the viscosity is less than the threshold.

6. The system of claim 5 wherein:

the controller is configured to determine whether the viscosity of the captured ink is within a range of viscosities, and to:

direct the first 3-way valve to discard the captured ink to the waste ink tank in response to determining that the viscosity is outside of the range of viscosities; and direct the first 3-way valve to recirculate the captured ink to the ink tank in response to determining that the viscosity is within the range of viscosities.

7. A method operable by a Drop-On-Demand (DOD) printing system, the method comprising:

detecting a start of an ink recirculation cycle;

collocating a recirculation cap proximate to nozzles of a DOD print head;

transporting ink from an ink tank to the DOD print head;

directing the DOD print head to begin ejecting ink through the nozzles into the recirculation cap to capture the ink;

selectively directing the captured ink to one of the ink tank and a waste ink tank;

measuring a viscosity of the captured ink;

determining whether the viscosity of the captured ink is greater than a threshold, and:

discarding the captured ink to the waste ink tank in response to determining that the viscosity is greater than the threshold; and recirculating the captured ink to the ink tank in response to determining that the viscosity is less than the threshold; and directing the DOD print head to stop ejecting the ink into the recirculation cap responsive to detecting an end of the ink recirculation cycle.

8. The method of claim 7 further comprising:

determining whether the viscosity of the captured ink is within a range of viscosities, and:

discarding the captured ink to the waste ink tank in response to determining that the viscosity is outside the range of viscosities; and recirculating the captured ink to the ink tank in response to determining that the viscosity is within the range of viscosities.

9. The method of claim 7 further comprising one of the following:

moving the print head proximate to the recirculation cap in response to the start of the ink recirculation cycle; and moving the recirculation cap proximate to the DOD print head in response to the start of the ink recirculation cycle.

10. The method of claim 7 further comprising:

determining that a viscosity of the captured ink is greater than a threshold; and adding ink to the ink tank to decrease the viscosity of the captured ink in response to the determination.

11. A non-transitory computer readable medium embodying programmed instructions which, when executed by a processor of a Drop-On-Demand (DOD) printing system, direct the processor to:

detect a start of an ink recirculation cycle;

collocate a recirculation cap proximate to nozzles of a DOD print head;

transport ink from an ink tank to the DOD print head;

direct the DOD print head to begin ejecting ink through the nozzles into the recirculation cap to capture the ink;

selectively direct the captured ink to one of the ink tank and a waste ink tank;

measure a viscosity of the captured ink;

determine whether the viscosity of the captured ink is greater than a threshold, and to:

discard the captured ink to the waste ink tank in response to determining that the viscosity is greater than the threshold; and recirculate the captured ink to the ink tank in response to determining that the viscosity is less than the threshold; and direct the DOD print head to stop ejecting the ink into the recirculation cap responsive to detecting an end of the ink recirculation cycle.

12. The non-transitory computer readable medium of claim 11, wherein the programmed instructions further direct the processor to:

determine whether the viscosity of the captured ink is within a range of viscosities, and to:

discard the captured ink to the waste ink tank in response to determining that the viscosity is outside of the range of viscosities; and recirculate the captured ink to the ink tank in response to determining that the viscosity is within the range of viscosities.

13. The non-transitory computer readable medium of claim 11, wherein the programmed instructions further direct the processor to:

direct the ink to one of the ink tank and the DOD print head during the ink recirculation cycle.

14. The non-transitory computer readable medium of claim 11, wherein the programmed instructions further direct the processor to perform one of the following in response to the start of the ink recirculation cycle:

move the print head proximate to the recirculation cap in response to the start of the ink recirculation cycle; and move the recirculation cap proximate to the DOD print head in response to the start of the ink recirculation cycle.

15. The non-transitory computer readable medium of claim 11, wherein the programmed instructions further direct the processor to:

determine that a viscosity of the captured ink is greater than a threshold; and add ink to the ink tank to decrease the viscosity of the captured ink in response to the determination.

* * * * *